US008567976B2

(12) United States Patent
Hamlin et al.

(10) Patent No.: US 8,567,976 B2
(45) Date of Patent: Oct. 29, 2013

(54) APPLIANCE DOORS HAVING INTEGRATED LIGHTING AND CONTROLS

(75) Inventors: Bradley Ray Hamlin, Canton, MI (US); Steven Martin Kowalski, Royal Oak, MI (US); John Joseph Bleau, Plymouth, MI (US)

(73) Assignee: Magna International Inc., Ontario (CA)

( * ) Notice: Subject to any disclaimer, the term of this patent is extended or adjusted under 35 U.S.C. 154(b) by 282 days.

(21) Appl. No.: 12/928,284

(22) Filed: Dec. 8, 2010

(65) Prior Publication Data

US 2011/0134627 A1 Jun. 9, 2011

Related U.S. Application Data

(60) Provisional application No. 61/283,698, filed on Dec. 8, 2009.

(51) Int. Cl.
*F21V 33/00* (2006.01)

(52) U.S. Cl.
USPC ..... 362/92; 362/249.01; 362/249.03

(58) Field of Classification Search
USPC ..... 362/92, 249.01, 249.03, 249.05, 94
See application file for complete search history.

(56) References Cited

U.S. PATENT DOCUMENTS

| | | | | |
|---|---|---|---|---|
| 7,931,381 | B2 * | 4/2011 | Balbinotti et al. | 362/92 |
| 2006/0075696 | A1 * | 4/2006 | Alessandro | 52/171.1 |
| 2009/0052160 | A1 * | 2/2009 | Park et al. | 362/92 |
| 2010/0065036 | A1 * | 3/2010 | Watkins et al. | 126/21 A |
| 2010/0142211 | A1 * | 6/2010 | Boelstler et al. | 362/355 |
| 2010/0180615 | A1 * | 7/2010 | Linder et al. | 62/248 |

FOREIGN PATENT DOCUMENTS

| | | |
|---|---|---|
| WO | WO 2006/060745 | 6/2006 |
| WO | WO 2009/036552 | 3/2009 |

* cited by examiner

*Primary Examiner* — Evan Dzierzynski
(74) *Attorney, Agent, or Firm* — Warn Partners, P.C.

(57) ABSTRACT

The present invention is an integrated control system for use with various home appliances, such as washing machine, dryers, refrigerators, dishwashers, and the like. In a first embodiment of the present invention, the integrated controls are incorporated into a polycarbonate clear door panel, and incorporate proximity switches and controls to provide control and operation of the applicance. Light emitting diodes (LEDs) are optionally incorporated into a door handle for the appliance in an area out of sight such that only the light produced by the LEDs is seen and illuminates a handle for opening the door of the appliance. Additionally, opaque glass technology may be incorporated into one or more surfaces of the appliance which enables an opaque panel to become transparent to view the content of the interior of the appliance, such as a refrigerator.

15 Claims, 6 Drawing Sheets

APPLIANCE DOORS HAVING INTEGRATED LIGHTING AND CONTROLS

CROSS-REFERENCE TO RELATED APPLICATIONS

This application claims priority to U.S. Provisional Application No. 61/283,698 filed on Dec. 8, 2009. The disclosure of the above application is incorporated herein by reference.

FIELD OF THE INVENTION

The present invention relates to the integration of controls for various appliances, such as washing machines, dryers, and refrigerators.

BACKGROUND OF THE INVENTION

Current household appliances have various types of controls, which are typically part of a control panel. For example, a washing machine usually includes a control panel mounted on top of the machine, and has various buttons which are used to control the various operations of the machine.

However, many typical home appliances, such as washing machines, dryers, and refrigerators, have controls which are located in an inconvenient location, or present an undesirable aesthetic appearance. Additionally, dirt and debris often accumulates on the buttons, making it difficult to keep the control panel clean.

Accordingly, there exists a need for controls used for home appliances which facilitate ease of use and also present a desirable aesthetic appearance, as well as make the appliances easier to keep clean.

SUMMARY OF THE INVENTION

The present invention is an integrated control system for use with various home appliances, such washing machines, dryers, refrigerators, dishwashers, and the like.

In a first embodiment of the present invention, the integrated controls are incorporated into a polycarbonate clear door panel, and incorporate proximity switches and controls to provide control and operation of the applicance.

In a second embodiment of the present invention, light emitting diodes (LEDs) are incorporated into a door handle for the appliance in an area out of sight such that while the LEDs themselves are not seen, the light produced by the LEDs is seen and uniformly illuminates a handle for opening the door of the appliance when the surrounding environment is under poor lighting conditions.

A third embodiment of the present invention is directed to opaque glass technology which is incorporated into one or more surfaces of the device which enables an opaque panel to become transparent to view the content of the interior of the appliance, such as a refrigerator. Lighting is also optionally incorporated to uniformly illuminate the inside of the refrigerator.

A fourth embodiment of the present invention is directed to a polycarbonate surface which includes embedded electronics and lighting, as well as touch sensitive switching used for operating a home appliance. Light is provided by LEDs, or other types of lighting, such as an electroluminescence strip.

Additional features of the invention also include a reduction in the amount of parts used to construct the invention because of the elimination of buttons used with typical control panels. The integration of a one-piece composite door panel multiple panels removes gaps and parting lines for an improved fit and finish. The integrated controls appear only as needed to reduce visual clutter, and because the controls are beneath the surface of the polycarbonate door panel, the controls have no A-surface paring lines, which results in an easy to clean surface.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
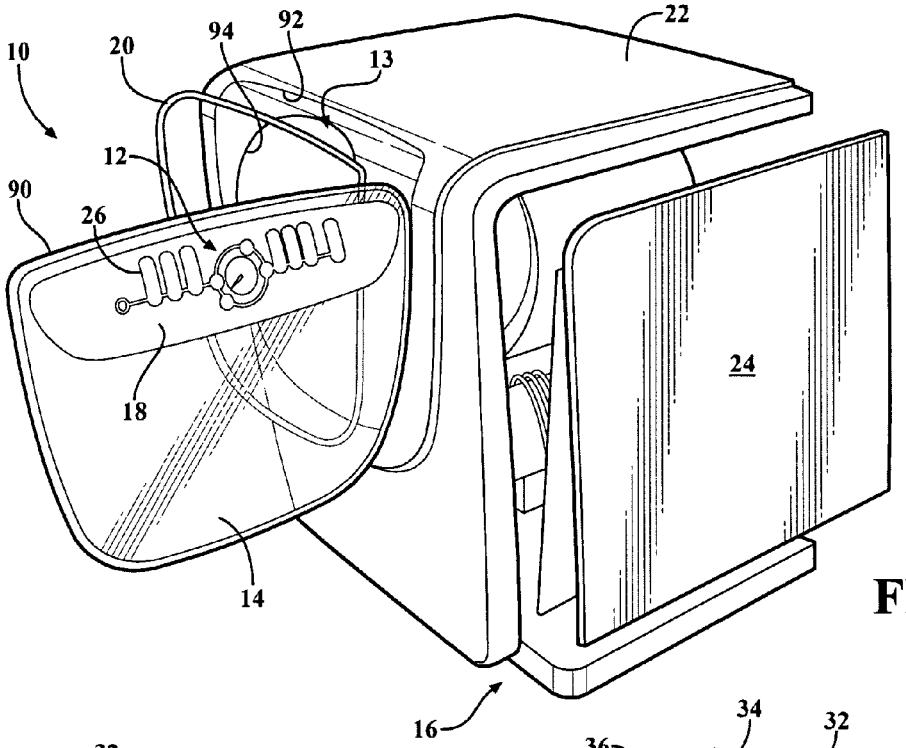
FIG. 1 is a perspective view of a home appliance incorporating a panel and integrated graphics and electronics, according to a first embodiment of the present invention.

A first embodiment of the present invention is shown in FIG. 1 generally at 10. In this embodiment, the present invention is an integrated control panel 12 and door panel 14 used for a home appliance 16, such as a washing machine or dryer.

The door panel 14 is made of a polycarbonate material, and the electronics for the control panel 12 are embedded into the door panel 14. The control panel 12 also includes a graphics layer 18 which is also embedded into the door panel 14. Also included is a seal 20 which provides a sealing function between the door panel 14 and a body 22 of the appliance 16. The body 22 of the appliance 16 is a thermoplastic, such as a sheet molding compound (SMC). The body 22 includes an access panel 24, which is removable to allow access to the mechanical components of the appliance 16 for maintenance and repair purposes. The seal 20, body 22, and the door panel 14 are part of an encapsulated seal system in which the seal 20, body 22, and the door panel 14 are molded simultaneously during manufacturing such that the seal 20 has a more accurate fit with the door panel 14 and the body 22, and prohibits debris and moisture from entering or exiting the appliance 16. More specifically, the outer lip 90 of the door panel 14, the seal 20, and the inner lip 92 of the body 22 which surrounds an opening 94 for providing access to the cavity 13 have a matching contour such that a more precise fit is provided between the door panel 14, the seal 20, and the body 22.

The control panel 12 also includes at set of proximity switches 26 (embedded into the door panel 14) which activate one or more lighting structures to provide lighting in the control panel 12 such that the various controls of the control panel 12 are seen as shown in FIG. 1. The switches 26 activate the lighting structures when a user's extremity, such as a finger or hand, is in proximity to the control panel 12. When the control panel 12 is not in use, or the appliance 16 is operating and does not require supervision, the lighting is deactivated. The door panel 14 is substantially transparent, and allows for viewing access to the inside of the appliance 16; there is a cavity 13 inside the appliance 16 which is viewed through the door panel 14. In this embodiment the appliance 16 is a washing machine or dryer; this allows viewing of the clothes in the as they undergo various cleaning cycles.

Figure 2A:
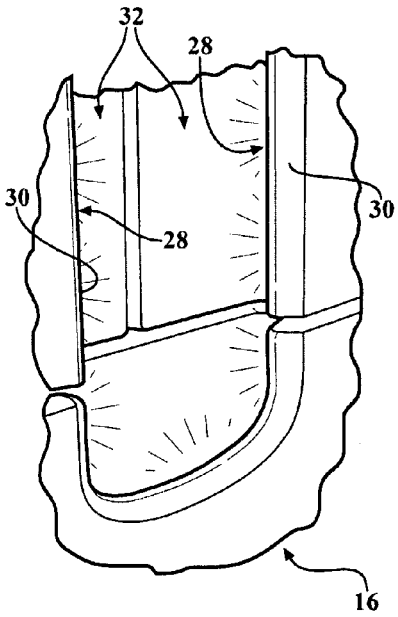
FIG. 2A is a first perspective view of a home appliance incorporating a lighting system, according to a second embodiment of the present invention.
Figure 2B:
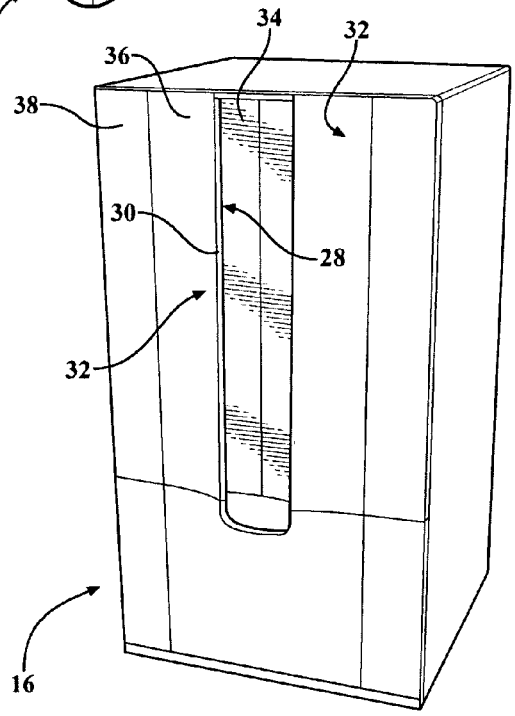
FIG. 2B is a second perspective view of a home appliance incorporating a lighting system, according to a second embodiment of the present invention.

A second embodiment of the present invention is shown in FIGS. 2A-2B. In this embodiment, the appliance 16 is a refrigerator. In FIGS. 2A and 2B, light is incorporated into recessed areas, generally shown at 28, in proximity to a set of door handles 30. Each of the door handles 30 are part of a door 32 which opens to allow access to the inside of the refrigerator. In this embodiment, the lighting is in the form of one or more LEDs, but it is within the scope of the invention that other types of light sources may be used to provide a uniform light distribution along the handles 30. LEDs which produce different color lighting are used in varying embodiments, such as the violet colored lights in FIG. 2A or the white light used in FIG. 2B.

Figure 3B:
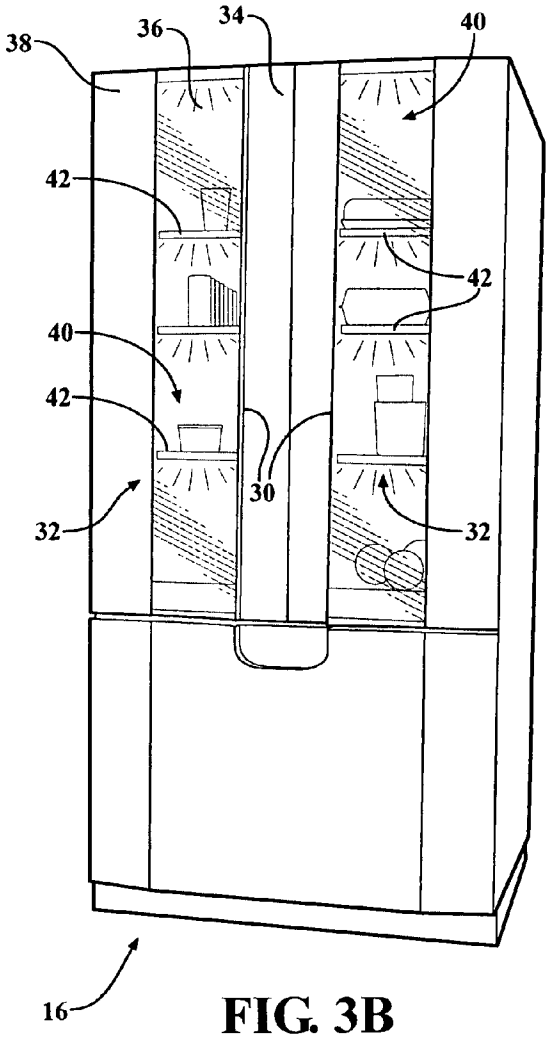
FIG. 3B is a second perspective view of a home appliance incorporating an opaque glass lighting system, according to a third embodiment of the present invention.
Figure 3A:
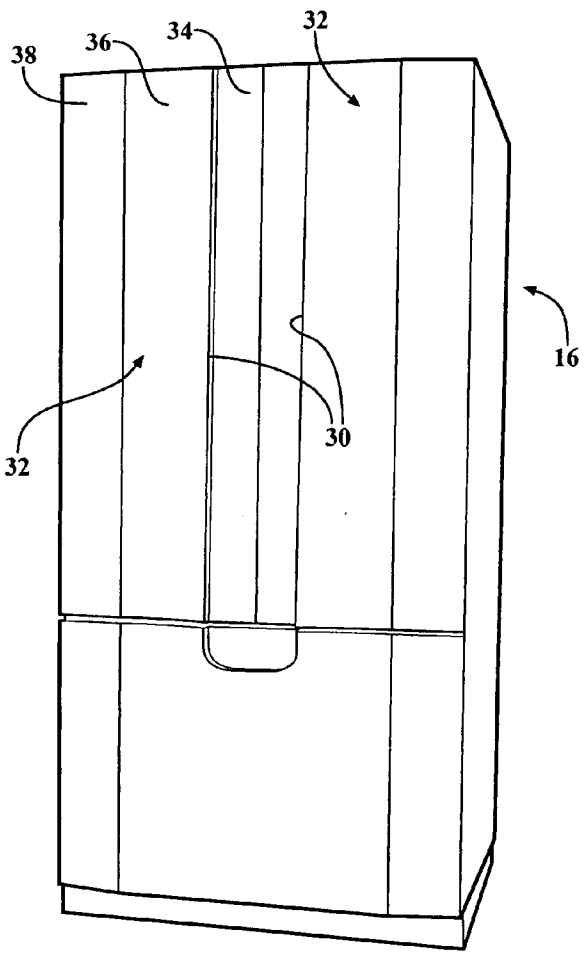
FIG. 3A is a first perspective view of a home appliance incorporating an opaque glass lighting system, according to a third embodiment of the present invention.

A third embodiment of the present invention is shown in FIGS. 3A and 3B. In this embodiment, the appliance 16 is also a refrigerator, and similar to the embodiment in FIGS. 2A-2B, wherein like numbers refer to like elements. In this embodiment, the doors 32 each have an inner panel 34, and intermediate panel 36, and an outer panel 38. The intermediate panel 36 has opaque glass technology in which the intermediate panel 36 is operable to switch from opaque to transparent, thereby allowing the content inside the refrigerator to be viewed. There is lighting which is used to provide illumination for the door handles 30, but there is also lighting incorporated into the inside cavity, generally shown at 40, and the LEDs are arranged to provide uniform light distribution inside the cavity 40 of the refrigerator. As with the previously described embodiments, there are also proximity switches which activate the LEDs such that when the user's hand comes into close contact with one of the intermediate panels 36 or the door handles 30, the lighting inside the cavity 40 is activated. In other alternate embodiments, the proximity switches are configured to activate either or both of the LEDs used for illuminating the recessed areas 28 of the door handles 30 as described in the previous embodiment; LEDs are also optionally incorporated into a set of shelves 42 which are located inside the cavity 40 upon which various items stored inside the cavity 40 are located.

Figure 4B:
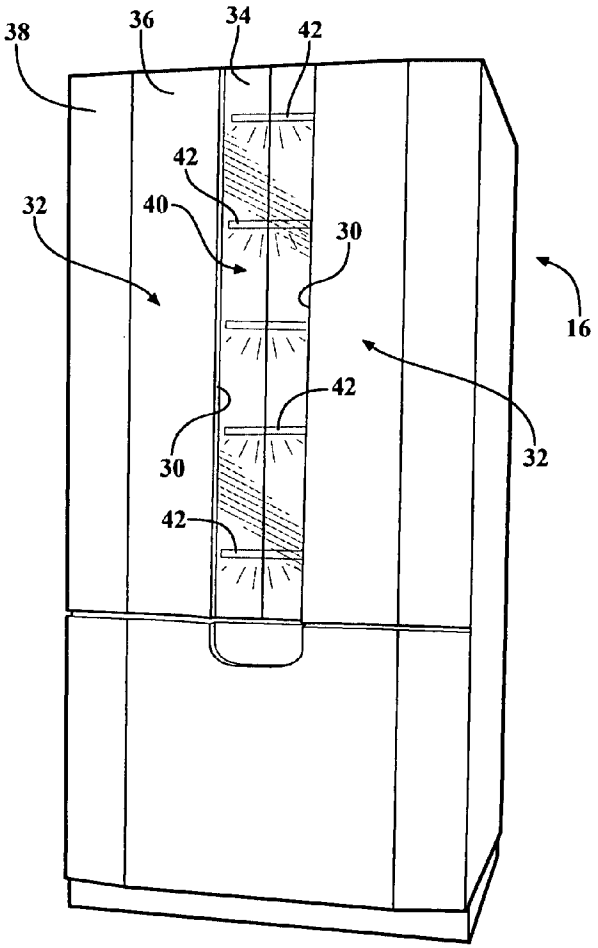
FIG. 4B is a fourth perspective view of a home appliance incorporating an opaque glass lighting system, according to a third embodiment of the present invention.
Figure 4A:
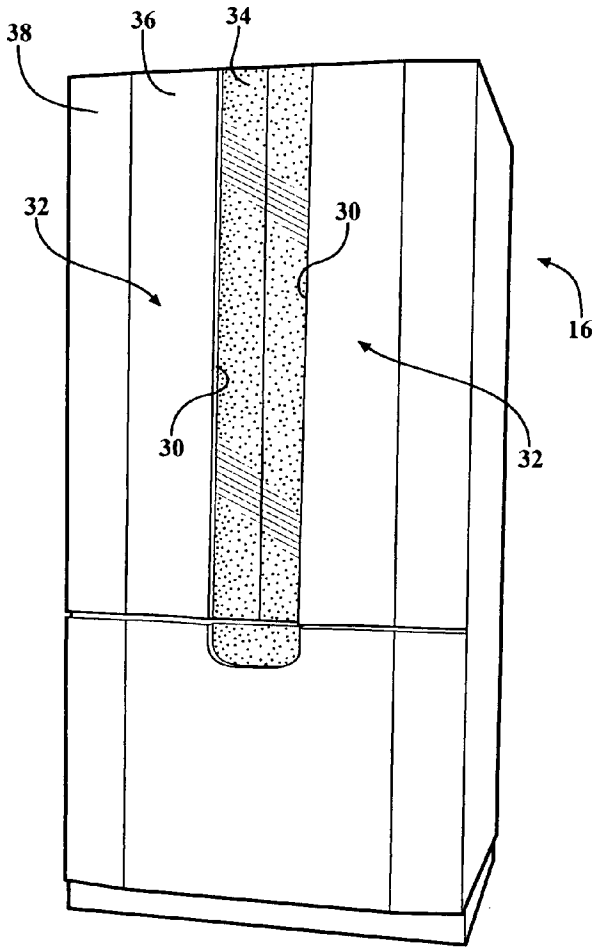
FIG. 4A is a third perspective view of a home appliance incorporating an opaque glass lighting system, according to a third embodiment of the present invention.

A fourth embodiment of the present invention is shown in FIGS. 4A and 4B. In this embodiment, the appliance 16 is a refrigerator, similar to the embodiment shown in FIGS. 2A-3B, with like numbers referring to like elements. In this embodiment, the doors 32 also incorporate opaque glass technology, but the inner panels 34 change from opaque to transparent, and vice versa through the activation of proximity switches. Alternatively, combinations of the panels 34,36 may be configured to be activated as desired, as well as combinations of the LEDs used to illuminate the shelves 42.

Figure 5A:
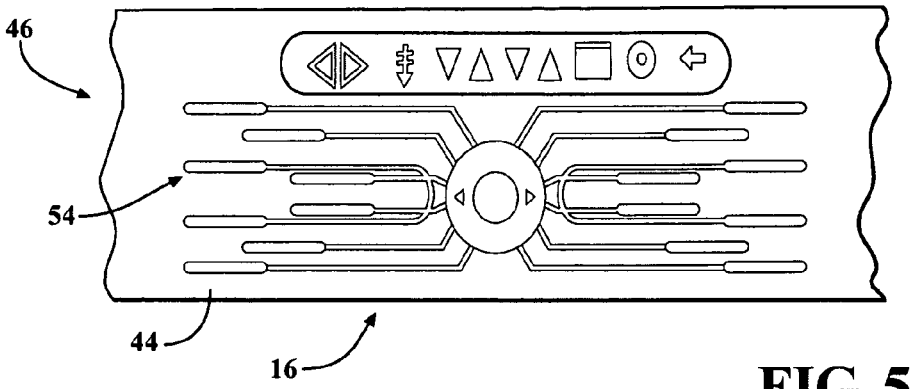
FIG. 5A is an enlarged perspective view of a home appliance incorporating a lighting system, according to a fourth embodiment of the present invention.
Figure 5B:
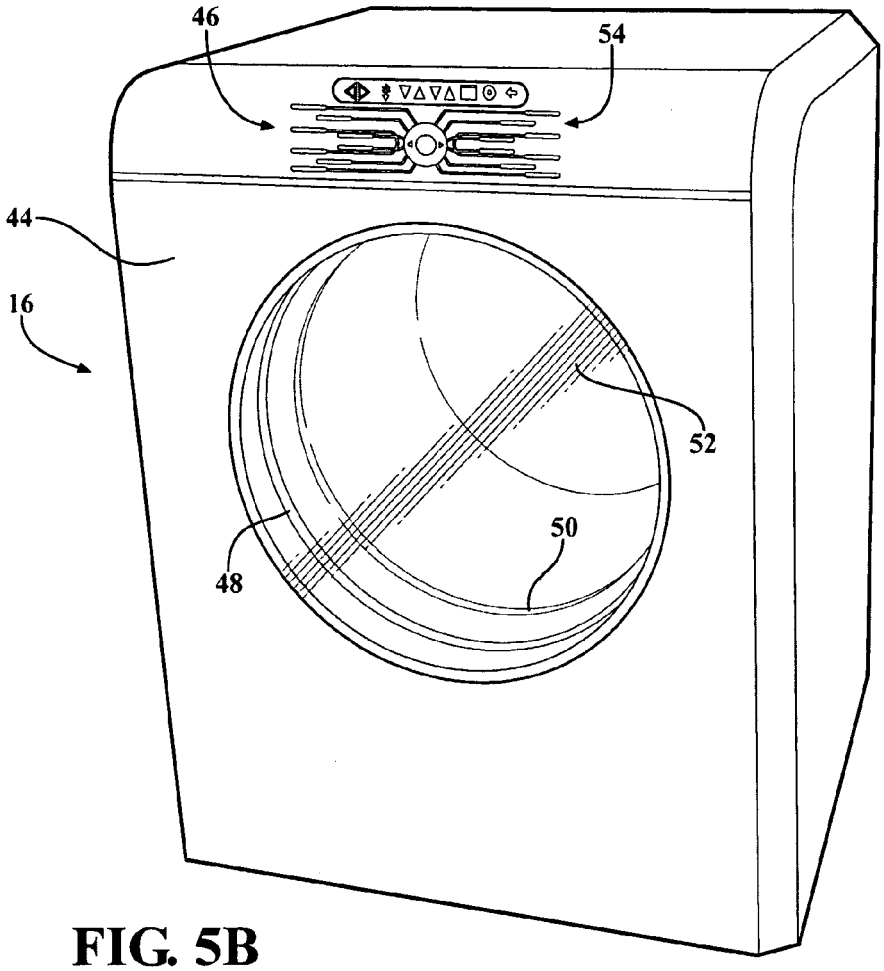
FIG. 5B is a perspective view of a home appliance incorporating a lighting system, according to a fourth embodiment of the present invention.

A fifth embodiment of the present invention is shown in FIGS. 5A and 5B. In this embodiment, the appliance 16 is a washing machine, but it is within the scope of the invention that the appliance 16 may be another type of home appliance, such as a dryer. This embodiment includes a polycarbonate door panel, generally shown at 66, which has a control panel, shown generally at 46. This embodiment is similar to the previous embodiments in that there are also LEDs used to provide illumination to the control panel 46, and proximity switches which are used to selectively activate the LEDs to illuminate the control panel 46 when a user's hand is in close proximity to the control panel 46. This embodiment also includes lighting 48 along the outer periphery of an opening 50, there is also a polycarbonate window 52 disposed in the opening 50. The polycarbonate window 52 allows for the inside of the appliance 16 to be seen when in use. The lighting 48 in one embodiment is a series of LEDs positioned to provide uniform illumination around the outer periphery of the opening 50 and the window 52.

Alternatively, different colored LEDs are used to provide an indication of what type of cycle is being performed by the appliance 16, such as, but not limited to, a wash cycle, a rinse cycle, or in the case of the appliance 16 being in the form of a dryer, a gentle drying cycle, or a high temperature drying cycle. Similar to the embodiment described in FIG. 1, the appliance 16 also includes a graphics layer 54 which is illuminated by the LEDs which are part of the control panel 46.

While the various embodiments of the present invention have been described using LEDs for providing illumination, other lighting devices may be used, such as electroluminescence strips, or the like.

Figure 6:
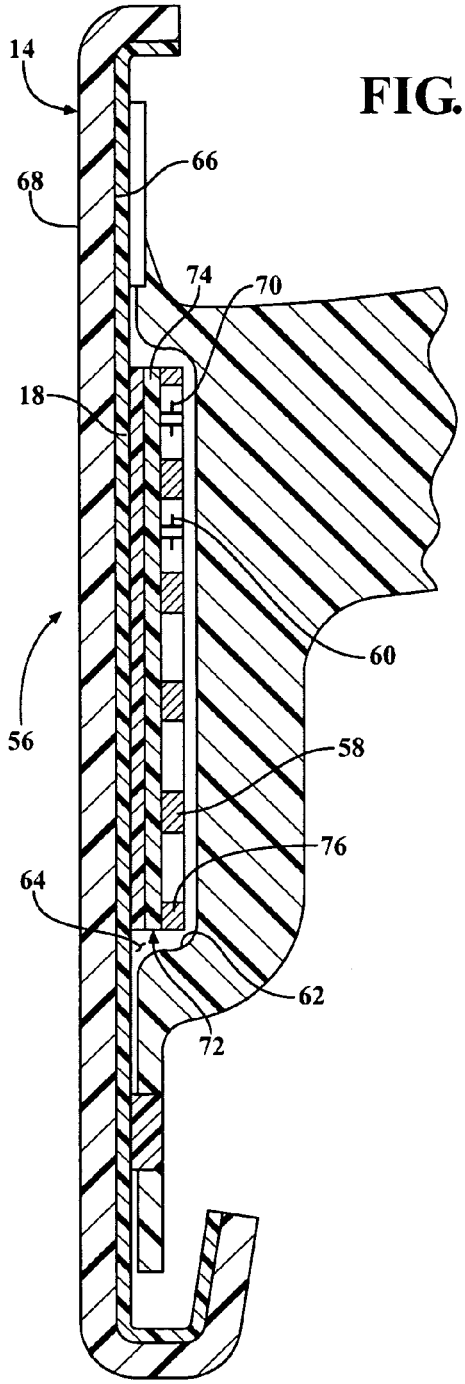
FIG. 6 is a first sectional view of an alternate embodiment of a lighting system for a control panel that is part of a home appliance, according to the present invention.
Figure 7:
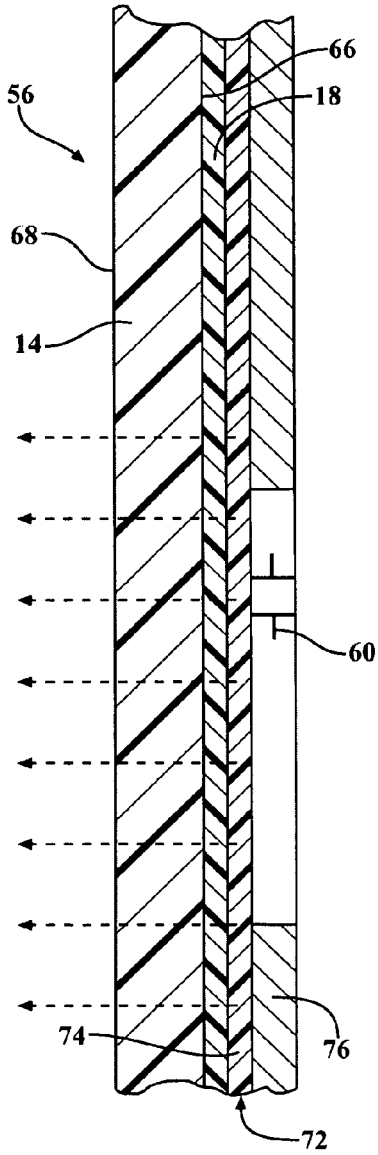
FIG. 7 is a second sectional view of an alternate embodiment of a lighting system for a control panel that is part of a home appliance, according to the present invention.

An example an alternate embodiment of the present invention is shown in FIGS. 6-7. In this embodiment, a portion of the door panel 14 is a tinted black or dark color polycarbonate or acrylic in standard ambient light conditions. Standard ambient light conditions include any type of outdoor lighting or the lack thereof. Therefore, the door panel 14 appears opaque in sunlight, darkness, and artificial, non-coherent light sources, which are typically used to provide lighting in darkness. The door panel 14 adds to the overall aesthetic design of the appliance 16. More specifically, the door panel 14 is used as a part of the overall design of the exterior of the appliance 16.

The composition of the door panel 14 allows the door panel 14 to act as a "dead front," meaning that it is opaque with respect to electromagnetic radiation in the visible portion of the spectrum of electromagnetic radiation, but transparent with respect to the radio frequency portion of the spectrum, in addition, the dead front door panel 14 is transparent to magnetic radiation as will be discussed later. In this embodiment, the door panel 14 is a tinted black or dark color polycarbonate, lexan, Lucite, ABS, nylon, polyethylene, polypropylene, acrylic or copolymers thereof.

While tinted black or dark color transparent polymers are disclosed above, any type of material which at least partially or fully hides the control panel 12 in ambient light but renders the control panel 12 visible through back lighting or other methods is useable in the present invention. For instance, mirrored or metallized films or materials, frosted or tinted glass, electrochromic materials or other changeable films or surfaces which are, or can be rendered, opaque under ambient light but allow viewing of the control panel 12 when desired are also useful as door panel 14 in the subject invention.

The door panel 14 covers a dead front actuating assembly, generally indicated at 56. Because the door panel 14 covers the dead front actuating assembly 56, the door panel 14 provides the dead front feature. More specifically, because the door panel 14 is opaque with respect to the view from the human eye, it appears as if there is nothing behind the door panel 14 when the dead front actuating assembly 56 is deactivated. With regard to location, the dead front actuating assembly 56 may be used with any home appliance, or any surface that is capable of having a polycarbonate, acrylic, or similar construction where a reduced amount of space is available for the dead front actuating assembly 56 to be mounted.

In the deactivated state, the dead front actuating assembly 56 is invisible due to the opaque nature of the door panel 14. In the activated state, a keypad, generally shown at 58, (which is part of the control panel 12) is illuminated and visible through the door panel 14. In the embodiment shown, the keypad 58 includes a plurality of switches 60 that are used in a combination to unlock the latch of the side door 12.

Referring to FIG. 6, a top view of the dead front actuating assembly 56 is shown with the door panel 14 in cross section. The dead front actuating assembly 56 includes a housing 62 that defines an interior volume 64. The housing 62 is fixedly secured to the door panel 14.

The door panel 14 defines an inboard surface 66 and an outboard surface 68. The outboard surface 68 is visible to those near the appliance 16. Therefore, the inboard surface 66 faces the interior volume 64 and the outboard surface 68 is opposite the inboard surface 66 and it is the outboard surface 68 that appears to be opaque to those standing outside the appliance 16 in standard ambient light conditions. The switches 60 are operable with the door panel 14, and are touch sensitive. More specifically, each of the plurality of switches 60 are activated by touching the door panel 14 in direct proximity to the specific switch 60 being "pressed" or activated. The switches 60 are sensors that detect a change in the capacitance of the door panel 14 in direct proximity to the location of the particular switch 60. The dead front actuating assembly 56 also includes a presence sensor 70. The presence sensor 70 identifies when an operator is disposed adjacent the door panel 14. In this embodiment, the presence sensor 70 is a touch sensor. The presence sensor 70 is a device such as a transceiver that sends a signal to the remaining components of the control panel 12 to identify when a users extremity, such as a finger or hand, enters the space in immediate proximity to the dead front actuating assembly 56, the plurality of switches 60 are then illuminated by the dead front actuating assembly 56.

The presence sensor 70 and the plurality of switches 60, in some embodiments, may be the same type of sensors. In fact, activating one of the plurality of switches 60 through touch may act as the presence sensor 70 to activate the non-contact dead front actuating assembly 56. In other instances, the presence sensor 70 and the plurality of switches 60 may be designed to be capacitive sensors, touch sensitive sensors, resistive sensors, temperature sensors, optical scanners or any combination thereof. The presence sensor 70 identifies the action by the operator of touching the door panel 14.

The dead front actuation assembly 56 also includes a lighting system inside the housing 62. The lighting system illuminates the door panel 14 such that light passes through the door panel 14 and out the outboard surface 68 to illuminate the location of the plurality of switches 60 for the operator. The lighting system includes a first layer, or electroluminescence strip, generally shown at 72, having at least one selectively illuminated area or electroluminescence area, shown generally at 74, which generates the light for the lighting system and is best shown in FIGS. 6-7. It should be appreciated that the electroluminescence strip 72 may be varied in size to satisfy the illumination requirements to allow an operator to identify the location of the switches 60. The electroluminescence strip 72 directs light in the interior volume 64 of the housing 62 to be directed toward the inboard surface 66 of the door panel 14.

The lighting system also includes a second layer, which in this embodiment is a sensor printed circuit board (PCB), generally shown at 76. The switches 60 are mounted to the PCB 76. In the embodiment shown, the presence sensor 70 is a touch sensor and is integrated into the PCB 76 in which the plurality of switches 60 are located. In an alternative embodiment, the presence sensor 70 may be mounted to a circuit board and identifies when the operator of the motor vehicle 10 approaches.

When the electroluminescence strip 72 is activated to produce light, the light from the illuminated area 74 passes through the door panel 14 to be viewed by the operator as modified by a third layer, which in this embodiment is a layer of graphics 18, similar to the previous embodiments. The switches 60 and presence sensor 70 are fabricated from electronics that are not, by design, readily visible to the operator. Therefore, the layer of graphics 18 is used to identify the location of each of the switches 60 when the electroluminescence strip 72 is activated. In a similar manner to the previous embodiments, the graphics 18 are not operative in and of themselves but are merely representations of the location of the switches 60, thereby allowing the operator to identify where each of the plurality of switches 60 are located to more accurately and efficiently operate the dead front actuating assembly 56. In an alternative embodiment, there are no graphics and the switches 60 are visible through the back lighting in a manner visible to the operator for selection thereby.

Connectors (not shown) are mounted to the PCB 76 and connect the dead front actuating assembly 56 to the electronics of the appliance 16 through wires to receive power and to communicate with the control panel 12. The PCB 76 includes electronics known in the art for providing proper operation of the appliance 16. In addition, the PCB 76 is operably associated with a controller (not shown). The controller includes electronics suitable for providing the necessary voltage to the plurality of switches 60 so the capacitances and changes therewith may be detected. Such changes in capacitance occur when an operator places a finger on the door panel 14 on or near the location of one of the plurality of switches 60. When the capacitance changes, the electronics on the PCB 76 identify the capacitance change as a selection of a particular location which is identified by the layer of graphics 18. In this particular case, the layer of graphics 18 typically represents buttons on the control panel 12. When the selections are made in various combinations, the controller sends a signal to operate the appliance 16, such as a washing machine, dryer, or refrigerator, whichever the case may be.

In operation, the dead front actuating assembly 56 is initially in an inactive state. When it is desired to use the appliance 16, the door panel 14 is initially touched, and the presence sensor 70 sends a signal to the controller, which then activates the electroluminescence strip 72, causing the electroluminescence strip 72 to produce light, thereby illuminating the layer of graphics 18. The switches 60 are activated by pressing on the control panel 12 in the location of the layer of graphics 18 representing each switch 60. As the switches 60 are pressed using the correct combination of numbers (or letters, or a combination of both), the door 12 will become unlocked.

It should be appreciated that the lighting system and delivery mechanism may be any type of lighting system that is able to be incorporated that can overcome opaque qualities of the door panel 14. Such examples of light source for the lighting system include, but are not limited to, sources that generate light through fluorescent, filament, phosphorescent or laser elements. Fiber optics and/or wave guides may direct the light should the source for the back light need to be in a different location. Another example of an alternate embodiment is shown in FIGS. 8-9, which is similar to the embodiment shown in FIGS. 6-7, with like numbers referring to like elements.

Figure 8:
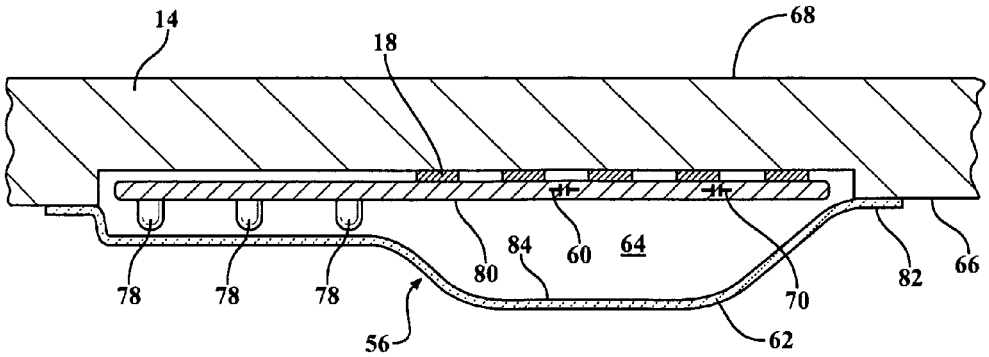
FIG. 8 is a first sectional view of another alternate embodiment of a lighting system for a control panel that is part of a home appliance, according to the present invention.
Figure 9:
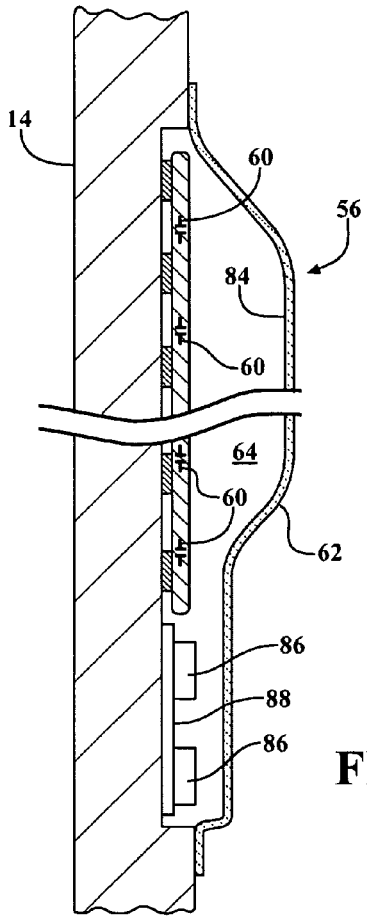
FIG. 9 is a second sectional view of another alternate embodiment of a lighting system for a control panel that is part of a home appliance, according to the present invention.

In the embodiment shown in FIGS. 8-9, instead of an electroluminescence strip 72, lighting is provided by a plurality of light emitting diodes (LEDs) 78 mounted on a plate 80, and the housing 62 defines a periphery 82 and includes a reflective surface 84. In this embodiment, light directed towards the interior volume 64 of the housing 62 is reflected by the reflective surface 84 towards the inboard surface 66, where light passes through the plate 80 and outboard surface 68 to be viewed by the person using the appliance 16 as modified by the layer of graphics 18. The dead front assembly 56 functions in a similar manner to the previously described embodiments, but light is provided by the LEDs 78, as opposed to other types of lighting as discussed above. As best, shown in FIG. 9, there is a plurality of connectors 86 mounted on an integrated circuit board 88 which connects the dead front actuating assembly 56 with the other electronic components of the appliance 16.

The description of the invention is merely exemplary in nature and, thus, variations that do not depart from the essence of the invention are intended to be within the scope of the invention. Such variations are not to be regarded as a departure from the spirit and scope of the invention.

What is claimed is:

1. An integrated control panel for a home appliance, comprising:

at least one panel pivotally connected to a home appliance for allowing access to the inside of said home appliance;

a plurality of controls embedded into said at least one panel; and one or more lighting structures embedded into said at least one panel, said one or more lighting structures selectively illuminated to provide substantially uniform illumination of said plurality of controls.

2. The integrated control panel for a home appliance of claim 1, further comprising at least one proximity switch for selectively activating said one or more lighting structures.

3. The integrated control panel for a home appliance of claim 1, said one or more lighting structures being one or more selected from the group consisting of light emitting diodes and electroluminescence strips.

4. The integrated control panel for a home appliance of claim 1, said at least one panel further comprising a substantially transparent polycarbonate door panel for allowing viewing access to the inside of said home appliance, said plurality of controls and said one or more lighting structures being embedded into said substantially transparent polycarbonate door panel.

5. The integrated control panel for a home appliance of claim 1, further comprising a graphics layer integrally formed with said at least one panel, said graphics layer providing an indication of the locations of each of said plurality of controls when said one or more lighting structures are activated.

6. The integrated control panel for a home appliance of claim 1, further comprising:

a body portion surrounding various mechanical components of said home appliance; and a seal surrounding said at least one panel for providing a sealing function between said at least one panel and said body portion.

7. The integrated control panel for a home appliance of claim 6, wherein said seal, said body portion, and said at least one panel are formed simultaneously during manufacturing of said seal, said body portion, and said at least one panel.

8. The integrated control panel for a home appliance of claim 1, said home appliance further comprising one selected from the group consisting of a washing machine and a dryer.

9. The integrated control panel for a home appliance of claim 1, further comprising:

an opening formed as part of said at least one panel;

a lighting system surrounding an outer portion of said opening formed as part of said at least one panel; and a window disposed in said opening formed as part of said at least one panel, such that said lighting system selectively illuminates said outer portion of said opening and an outer periphery of said window.

10. A control panel integrated into a home appliance, comprising:

at least one panel, said at least one panel being part of a home applicance;

a plurality of controls integrally formed with said at least one panel;

a plurality of lighting structures embedded into said at least one panel;

a graphics layer integrally formed with said at least one panel in proximity to said plurality of controls such that said graphics layer provides an indication of the location of each of said plurality of controls when said plurality of lighting structures are activated; and at least one proximity switch operable for selectively activating each of said plurality of lighting structures;

wherein said at least one proximity switch activates each of said plurality of lighting structures when an operator is in proximity to said proximity switch, such that said plurality of lighting structures project light through at least a portion of said graphics layer.

11. The integrated control panel for a home appliance of claim 10, wherein said plurality of lighting structures are one selected from the group consisting of light emitting diodes, electroluminescence strips, and combinations thereof.

12. The integrated control panel for a home appliance of claim 10, further comprising:

a body portion surrounding various mechanical components of said home appliance; and a seal surrounding said at least one panel for providing a sealing function between said at least one panel and said body portion, wherein said seal, said body portion, and said at least one panel are formed simultaneously during the manufacturing of said seal, said body portion, such that said at least one panel, said body, and said seal having a matching contour.

13. The integrated control panel for a home appliance of claim 10, wherein said at least one panel is a substantially transparent polycarbonate door panel for allowing viewing access to the inside of said home appliance, one or more of said plurality of controls and one or more of said plurality of lighting structures being embedded into said substantially transparent polycarbonate door panel.

14. The integrated control panel for a home appliance of claim 10, further comprising:

an opening formed as part of said at least one panel, said opening having an outer portion;

a lighting system connected to and surrounding said outer portion formed as part of said opening; and a window mounted in said opening formed as part of said at least one panel, wherein said lighting system selectively illuminates said outer portion of said opening and an outer periphery of said window.

15. The integrated control panel for a home appliance of claim 10, wherein said home appliance is one selected from the group consisting of a washer and a dryer.

* * * * *